US005183395A

United States Patent [19]

Langouet

[11] Patent Number: 5,183,395

[45] Date of Patent: Feb. 2, 1993

[54] COMPRESSOR SLIDE VALVE CONTROL

[75] Inventor: Luc Langouet, Muskego, Wis.

[73] Assignee: Vilter Manufacturing Corporation, Milwaukee, Wis.

[21] Appl. No.: 850,583

[22] Filed: Mar. 13, 1992

[51] Int. Cl.[5] ..... F04B 49/00

[52] U.S. Cl. ..... 417/310; 417/440

[58] Field of Search ..... 417/310, 440; 418/201.2

[56] References Cited

U.S. PATENT DOCUMENTS

| | | | |
|---|---|---|---|
| Re. 31,379 | 9/1983 | Shaw | 417/310 |
| 4,516,914 | 5/1985 | Murphy | 417/310 |
| 4,575,323 | 3/1986 | Yoshimura | 417/440 |
| 4,704,069 | 11/1987 | Kocher et al. | 417/310 |
| 4,743,170 | 5/1988 | Marshall | 417/310 |
| 5,044,894 | 9/1991 | Field et al. | 417/310 |
| 5,123,822 | 6/1992 | Yoshimura | 418/201.2 |
| 5,135,374 | 8/1992 | Yoshimura et al. | 418/201.2 |

*Primary Examiner*—Richard A. Bertsch
*Assistant Examiner*—Alfred Basichas
*Attorney, Agent, or Firm*—Nilles & Nilles

[57] ABSTRACT

A variable capacity rotary screw compressor having a rotor housing including a bore, an inlet, an outlet, a slide valve recess and rotors. Passive and active slide valves are mounted in the recess. Individual passive and active slide valve balancing units are connected to the passive and active slide valves respectively. A prime mover is connected to selectively regulate the position of the active slide valve. A first conduit is connected between the housing inlet and the passive and active slide valve balancing units and includes a first valve operable to either open or close the first conduit. A second conduit is connected in fluid communication between the outlet and the passive and active slide valve balancing units and includes a second valve operable to either open or close the second conduit. A first sensor provides a first signal proportional to suction pressure. A second sensor provides a second signal proportional to discharge pressure. A third sensor provides a third signal proportional to the position of the active slide. A control receives the first, second and third signals and provides: first and second control outputs to open either the first or the second valve to balance the passive and active slide valves with either suction or discharge pressure; and a third control output connected to the prime mover for regulating the position of the active slide valve.

10 Claims, 3 Drawing Sheets

SUCTION PRESSURE TRANSDUCER
SLIDE VALVE POTENTIOMETER
DISCHARGE PRESSURE TRANSDUCER
ANALOG INPUT
PROGRAM
MICRO COMPUTER
DISPLAY
BINARY OUTPUT
CAPACITY CONTROL
VOLUME CONTROL
SLIDE CONTROL TO RIGHT
SLIDE CONTROL TO LEFT

COMPRESSOR SLIDE VALVE CONTROL

BACKGROUND OF THE INVENTION

This invention relates to screw compressors of the type having a slide valve and more particularly to a control for an axially shiftable slide valve for regulating the volume ratio and the capacity of the compressor.

DESCRIPTION OF THE PRIOR ART

Variable capacity rotary screw compressors are known that have a pair of helical rotors mounted within a housing for compressing fluid drawn from an inlet at suction pressure and discharging the compressed fluid through an outlet at a higher discharge pressure. It is also known to provide a slide valve that is axially slidable in a recess in the compressor housing to control the volume ratio (sometimes referred to in the art as compression ratio) and the capacity of the compressor. U.S. Pat. No. 4,516,914, issued to David A. Murphy on May 14, 1985, discloses a rotary screw compressor of the above type having a two-piece slide valve assembly that includes a slide valve and a slide stop coaxially mounted for axial sliding movement toward and away from each other. The slide valve and slide stop each have an inner face end with the inner faces being in confronting relation to each other to provide an opening variable in size and axial position. Both the slide valve and slide stop are "active" in that their positions are regulated by hydraulic pistons. A first double-acting piston is connected to the slide valve to provide positive regulation of the position thereof and the position of the slide stop is controlled independently of the slide stop by a second and separate double-acting piston. Both pistons are energized by lubricating oil pressure controlled by hydraulic valves. First and second sensing means sense the pressure at the discharge and inlet openings, respectively. Third and fourth separate and independent sensing means sense the position of the slide valve and slide stop members, respectively. A microcomputer is responsive to the four sensing means to constantly energize the first and second pistons independently of each other to regulate the positions of the slide valve and slide stop to control the volume ratio and capacity of the compressor.

The basic objective of such compressor arrangements is to control a compressor system condition which, for example, could be the amount of refrigerated gas usually expressed in pounds, passing through the compressor which will determine the temperature at which a refrigeration unit connected to the compressor is maintained. In many processing industries, the process temperature must be maintained within extremely close tolerances to avoid process failure or diminution of final product quality. The desired condition is programmed into the microcomputer. The microcomputer then senses the actual system condition, compares it with the desired condition and actively regulates the positions of both the slide valve and slide stop in response to a program installed therein to maintain the actual condition as close as possible to the desired condition.

One problem of prior art systems that works against precise control of the system condition is the lag in response time of a multiplicity of mechanical and hydraulic components, such as the valves and double-acting pistons which must respond to the energization by oil pressure. The lag in response time results in compressor hunting, that is, the compressor will continue to respond even though desired condition parameters are met and this results in a less precise control of the system condition such as temperature control. Further, hunting significantly increases the frequency of piston energization which results in more rapid wear of the mechanical components such as the piston rings and cylinder. Such wear ultimately results in leakage and any leaking of lubricating oil from one side of a piston to the other causes the position of the piston to drift from its desired set point and this exacerbates hunting.

The system of U.S. Pat. No. 4,516,914, discussed above, develops a total of four sensing signals used by the microcomputer to provide positive independent actuation of the two double-acting hydraulic pistons. This results in a complex arrangement that is more expensive to manufacture and assemble. The need for constant active regulation of each double-acting piston increases the effect of response time and wear.

SUMMARY OF THE INVENTION

The present invention provides an improved slide valve control of simplified design having a reduced number of components and a lesser number of sensing signals to thereby reduce response time and provide a more precise control of a compressor condition while also minimizing wear of the control components. The compressor is provided with a two-piece slide valve comprising a passive slide valve and an active slide valve. A passive slide valve balancing means including a piston is connected to the passive slide with one side exposed permanently to suction pressure and an active slide valve balancing means including a piston is connected to the active slide with one side exposed permanently to discharge pressure. The compressor control connects both of the balancing pistons either to suction pressure or to discharge pressure. The two balancing pistons do not actively regulate or adjust the position of the passive and active slide valves, but, instead, they function to counterbalance the axial load that is applied on the active slide valve. A prime mover is connected only to the active slide valve to provide active or positive regulation of the position of the active slide valve. There is no active or positive regulation of the position of the passive slide valve. With my novel slide valve arrangement, the microcomputer needs to only sense three operating parameters, that is, suction pressure, discharge pressure and the position of the active slide valve.

More specifically, a variable capacity rotary screw compressor incorporating my invention comprises a rotor housing that includes a bore means having an inlet at a suction pressure, a discharge bore having an outlet at a discharge pressure, inner and outer passive slide valve chambers, an outer active slide valve chamber, and a slide valve recess in fluid communication between the bore means and the inlet. A rotor means is mounted for rotation in the bore means to compress fluid received from the inlet and discharge the fluid at a higher pressure through the outlet. A passive slide valve means and an active slide means is mounted for axial movement in the slide valve recess and connected to be either in sealing position to prevent fluid communication through the recess or in positions defining a variable volume opening therebetween placing the bore and inlet in fluid communication. A passive slide valve balancing means is mounted between said outer and inner passive slide valve chambers and connected to the passive slide valve means. An active slide valve balancing means is mounted between said discharge bore and said outer active slide valve chamber and is connected to the active slide valve means. A duct means connects the inner passive slide valve chamber in permanently open fluid communication with suction pressure. A prime mover is connected to selectively regulate the position of the active slide valve means. A conduit means including valve means is provided for selectively connecting the passive and active slide valve balancing chambers in communication with either suction or discharge pressure. A control means is operatively connected to the valve means to place both the outer passive slide valve chamber and the outer active slide valve chamber in fluid communication with either suction or discharge pressure to counterbalance axial thrust imposed on the active slide valve with either suction or discharge pressure and to actuate the prime mover to regulate the position of the active slide valve.

More specifically, the valve means has first and second valves and the control means provides first and second control outputs that are connected to the first and second valve means to open either the first or second valve means. When the first valve means is open, both of the balancing means are in communication with the inlet to counterbalance the axial load on the active slide with the use of suction pressure. When the second valve means is open, both of the balancing means are in communication with the outlet to counterbalance the axial load on the active slide by the use of discharge pressure. The control means also provides a third control output connected to the prime mover for regulating the position of the active slide valve means.

BRIEF DESCRIPTION OF DRAWINGS

Referring to the drawings.

DESCRIPTION OF THE PREFERRED EMBODIMENTS

Figure 1:
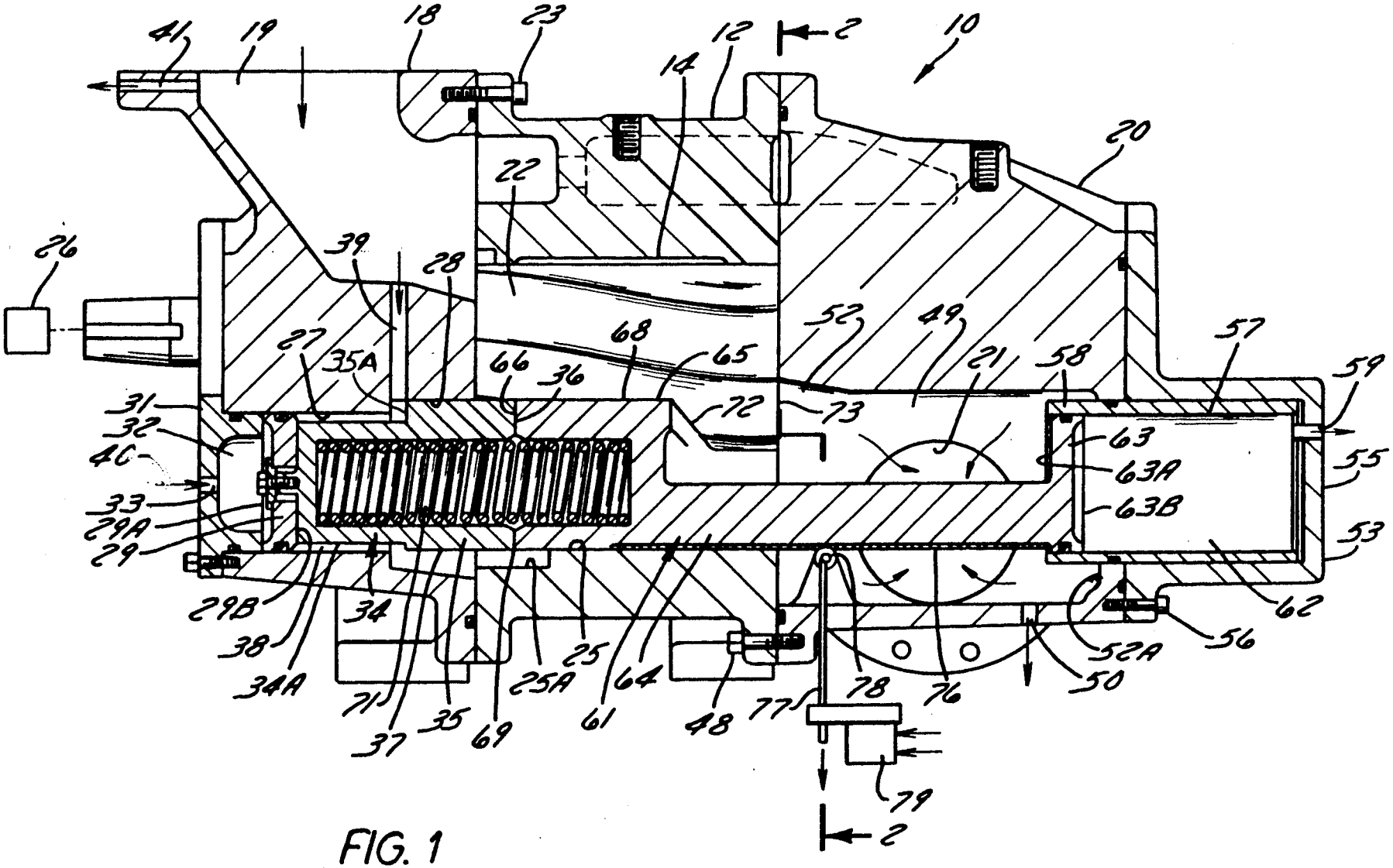
FIG. 1 is a horizontal section view of a rotary screw compressor with some components shown in schematic form.
Figure 2:
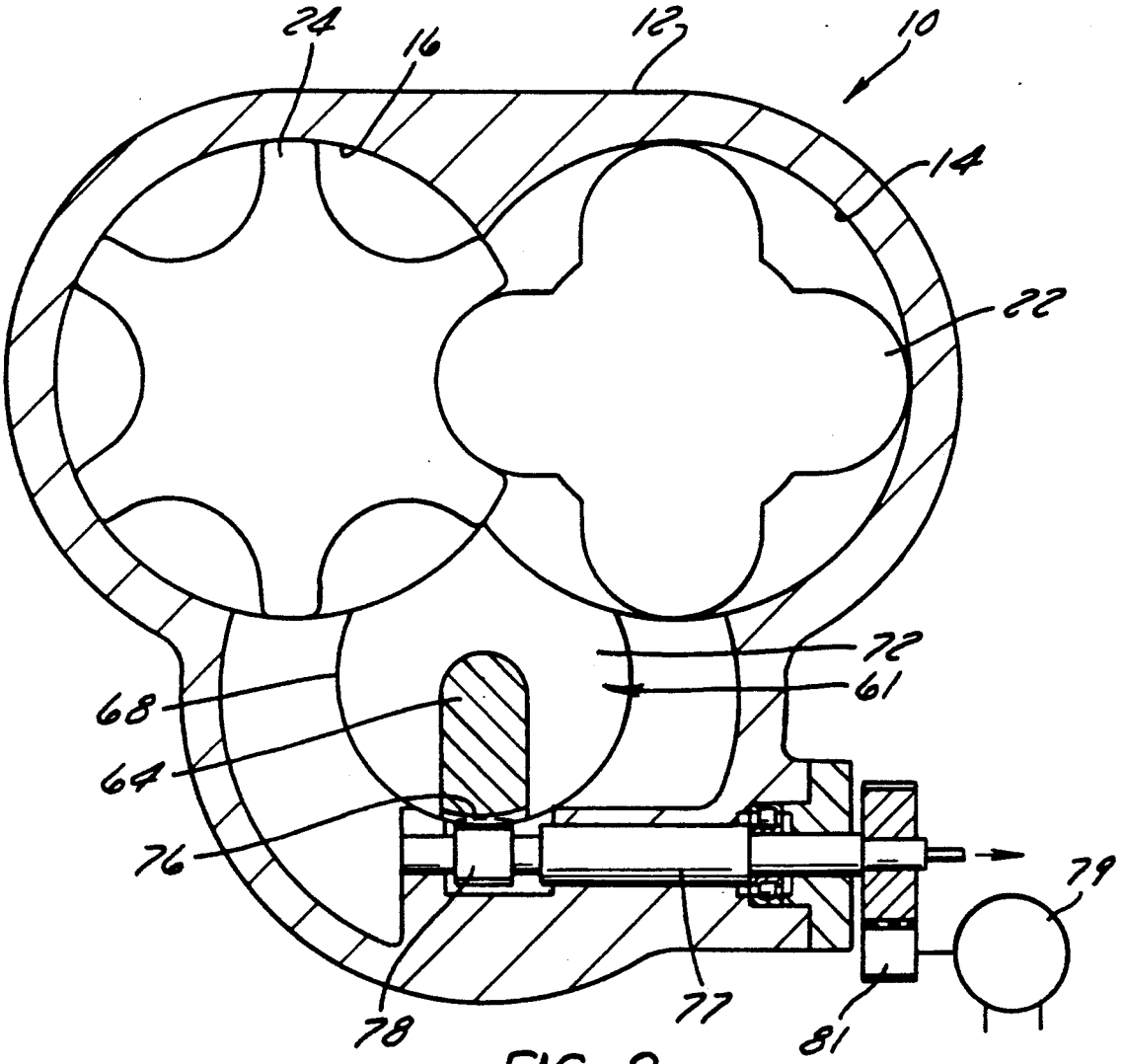
FIG. 2 is a sectional view taken along line 2—2 of FIG. 1.

Referring to FIGS. 1 and 2, a rotary screw compressor 10 is shown that comprises a rotor housing 12 presenting intersecting bore means 14, 16, a low pressure end having a suction end portion or casing 18 including an inlet 19 and a high pressure end having a discharge pressure end portion or casing 20 having a discharge bore 49 of an suitable shape and an outlet 21. Intermeshing male and female rotors 22 and 24 are rotatably mounted by bearings (not shown) on parallel axes in the intersecting bores 14 and 16 in known manner. The rotors 22 and 24 are driven by motor 26. Fluid such as a gas is trapped in compression chambers formed by grooves of the intermeshed rotors and is compressed as the rotors rotate to gradually reduce the size of the compression chambers in known manner. The housing 12 also includes an axially extending slide valve receiving recess 25, 25A which is in fluid communication between the bores 14, 16 and the inlet 19.

Figure 3:
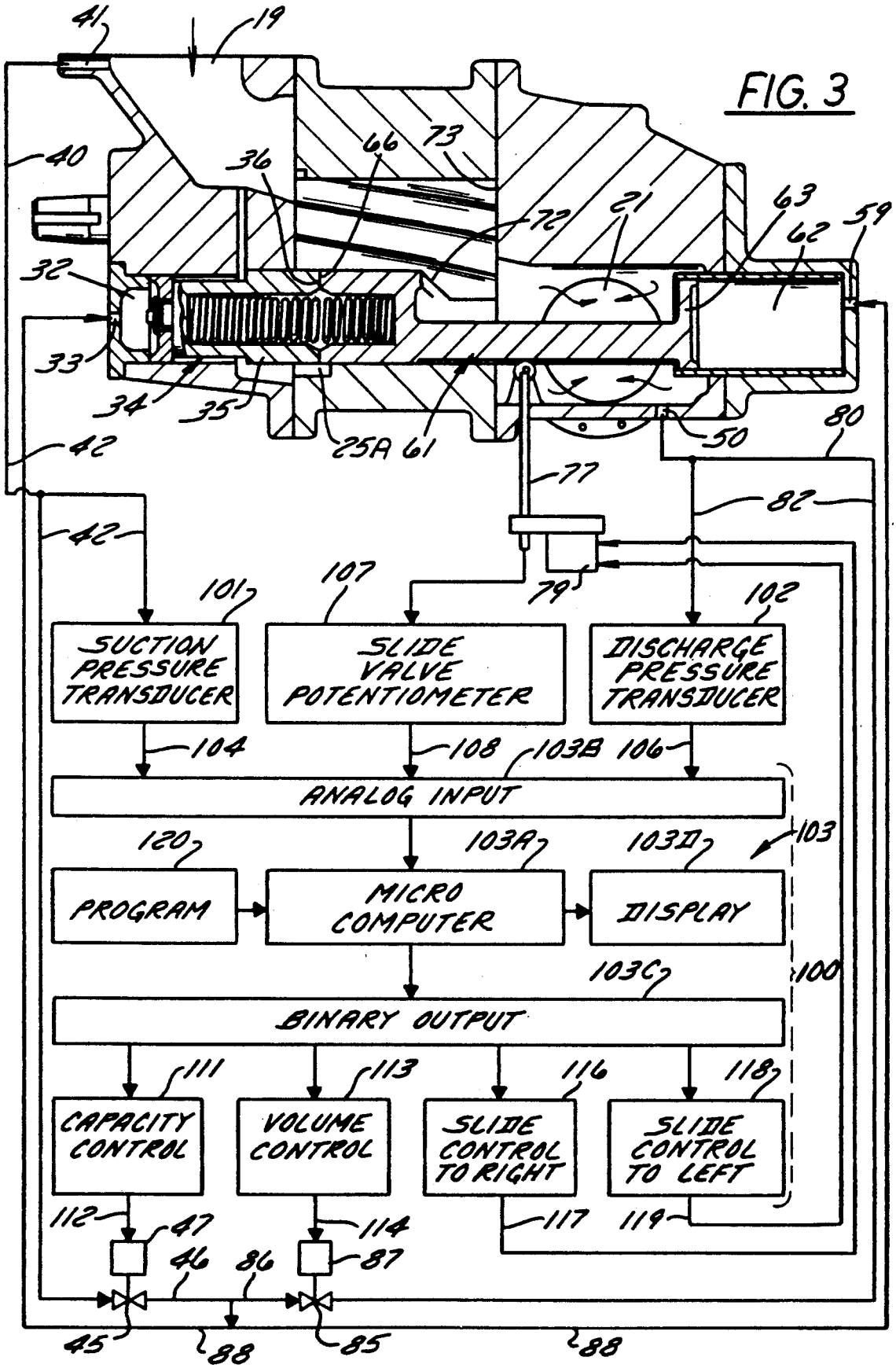
FIG. 3 is a schematic view showing the compressor and associated control circuits.

The suction end casing 18 is secured to housing 12 by bolts 23 and includes part of the slide valve recess 25 which comprises an outer bore 27 of a first diameter and an inner counterbore 28 of a second diameter larger than the first diameter and outer and inner passive slide valve chambers 32, 38. The recess 25 has an opening 25A which is in communication with inlet 19. A first piston 29 is slidably mounted in the outer bore 27. The outer bore 27 is closed by an end cap 31 which defines the outer passive slide chamber 32 between it and the piston 29. The piston 29 is part of a first pressure actuated means and has a first inner side 29B facing the inner chamber 38 that is permanently exposed to suction pressure via duct 39 and a first outer side 29A facing outer chamber 32. End cap 31 includes a first port 33 that is part of a first conduit means 40 (FIG. 3). The first conduit means 40 is in open communication with outer chamber 32 via first port 33. The suction end casing 18 further includes a second port 41 opening into inlet 19. Second port 41 is also part of the first conduit means 40, which will be more fully described hereinafter.

A passive slide valve means 34 having a passive slide valve spool 35 is slidably mounted in the bores 27, 28. The passive slide valve spool 35 includes a first inner facing end 36 and a peripheral portion 37 in sealing relation to rotors 22, 24 and a reduced portion 34A. The spool 35 also has an inlet end portion or face 35A that interfaces with a reduced portion 34A of passive valve 34 and cooperates with bore 27 to define the inner passive slide valve chamber 38. As duct means 39 connects inner chamber 38 in open fluid communication with inlet 19, the inner chamber 38, the inner surface 29A of piston 29 facing chamber 38 and face 35A are permanently exposed to suction pressure. The passive slide valve 34 is connected to piston 29 thus placing piston 29 in reciprocal sealing relation between the passive slide valve outer and inner chambers 32, 38. The end cap 31, chambers 32, 38 and piston 29 constitute a passive slide valve balancing means.

The discharge end casing 20 is secured t housing 12 by bolts 48 and includes the discharge bore 49 which has open interior and outer ends 52, 52A, the outlet 21, and a third port 50. The discharge end casing 20 is also provided with an end cap 53 secured in surrounding relation to the open outer end 52A of the discharge bore 49 by cap screws 56. The open interior end 52A faces the rotor bores 14, 16 to admit compressed fluid from the rotors 22, 24 into the end casing discharge bore 49 for exhaust through outlet 21. The end cap 53 has a cylinder 57 therein presenting an open end 58 facing into the discharge bore 49 and a closed end 55 having a fourth port 59. The third and fourth ports 50 and 59 are part of a second conduit means 80 (FIG. 3) that will be more fully described hereinafter.

An active slide valve means 61 is slidably mounted in the recess 25 to move toward and away from the passive slide valve 34. The active slide valve 61 includes an active slide valve spool 65 having a second inner facing end 66 in facing relation to first inner facing end 36 and a peripheral portion 68 in sealing relation with rotors 22, 24. A spring 71 may be mounted between the inner facing ends 36, 66. In operation, the ends 36, 66 will move toward and away from each other to create a gap 69 varible in size and axial position that places the bores 14, 16 in fluid communication with inlet 19 via opening 25A. When the inner facing ends 36, 66 are in contact with each other, they form a seal preventing fluid communication through the recess 25, 25A to inlet 19. The outer end of spool 65 has a discharge end portion or face 72 which is in open facing communication with the discharge bore 49 and moves toward or away from the edge 73 of the outlet casing 20 as active valve 61 moves.

Therefore, the end face 72 of active slide valve means 61 is permanently exposed to the discharge pressure.

An active slide valve balancing means in the form of a second piston 63 is mounted for reciprocation in cylinder 57. The second piston 63 cooperates with cylinder 57 to form an outer active slide valve chamber 62. The piston 63 is a second pressure actuated means that is mounted between the discharge bore 49 and the outer chamber 62. The piston 63 is connected to the active slide valve 61 by a piston rod 64. Preferably the piston rod 64 is formed integral with active valve spool 65 and second piston 63. However, it is also contemplated that the valve spool 65, piston rod 64 and piston 63 could comprise a three-piece assembly of individual components. Piston 63 has the same cross-sectional area as does the active slide valve 61. The second piston 63 has a first inner side 63A facing discharge bore 49 which is permanently exposed to discharge pressure and a second outer side 63B facing outer chamber 62.

The piston rod 64 includes a gear rack 76 that faces downward as shown in FIGS. 1 and 2. A pinion gear 78 is fixedly secured on a pinion drive shaft 77 and meshes with gear rack 76. A prime mover such as a reversible rotation motor 79 is connected by a gear train 81 in driving relation to shaft 77.

From the foregoing description, it is to be noted that the two balancing pistons 38, 63 do not actively regulate the position of the passive and active slide valves 34, 61. Instead, the pistons 38, 63 counterbalance the axial load that is applied on the active slide valve by discharge pressure in discharge bore 49 during operation.

The first and second conduit means 40 and 80 comprise a conduit means that will now be described with reference to FIG. 3. The first conduit means 40 includes a first suction conduit segment 42 that connects second port 41 (at suction pressure) in fluid communication with a suction pressure transducer 101 of a control means 100, that will be described hereinafter, and with an input side of a first valve means 45 operated by a servomotor 47. The first conduit means 40 also includes a first valve bipressure conduit segment 46, and a common conduit 88 that connects an output side of valve 45 in fluid communication with first port 33 and fourth port 59. When valve 45 is open, first and fourth ports 33 and 59 are both connected to second port 41 and thus are both at suction pressure.

The second conduit means 80 includes a first discharge conduit segment 82 that connects third port 50 (at discharge) pressure in fluid communication with a discharge pressure transducer 102 of the control means 100 and with an input side of a second valve means 85 operated by a servomotor 87. The second conduit means 80 also includes a second bipressure conduit segment 86 and the common conduit 88 that connects an output side of valve 85 in fluid communication with first and fourth ports 33 and 59. The first and second valve bipressure conduits 46, 86 are connected in open fluid communication with each other in any suitable manner. When valve 85 is open, first and fourth ports 33 and 59 are both connected to third port 50 and thus are at discharge pressure. Therefore, depending on which valve (45 or 85) is open, bipressure conduit segments 46, 86 and common conduit 88 will be either at suction or at discharge pressure.

The suction pressure transducer 101 which is connected to first conduit means 40 produces a first signal 104 proportional to suction pressure at port 41; the discharge pressure transducer 102 which is connected to second conduit means 80 produces a second signal 106 proportional to discharge pressure at port 50; and a slide valve potentiometer 107 is connected to shaft 77 to produce a third signal 108 responsive to the position of active slide valve 61.

The control means 100 will now be described. The control means 100 includes: a microcomputer unit 103 that comprises a programmable microcomputer 103A, an analog input 103B, a binary output 103C and a display 103D. A suitable microcomputer unit 103 can be purchased from Micrometics International Inc. of Greendale, Wis., part number 110-6019-00. The control means 100 further includes a capacity control 111 having a first control output 112 connected to actuate servomotor 47 to either open or close valve 45; a volume control 113 having a second control output 114 connected to actuate servomotor 87 to either open or close valve 85; an active slide valve control right direction control 116 having an output 117 operative when energized to cause motor 79 to move the active slide valve end face 72 toward edge 73; and an active slide valve control left direction control 118 having an output 119 operative when energized to cause motor 79 to move the active slide valve end face 72 away from edge 73. The outputs 117 and 119 constitute a third control output of control means 100.

A flow chart for a typical program 120 for operating the control means 100 would be as follows. The abbreviations used in the text of the flow chart are defined in the flow chart. With regard to the phrase "VR=Control Mode", in the following program it is to be understood that "Control Mode" refers to either of two conditions, i.e. the passive and active slide valves 34, 61 are maintained together as a unit due to discharge pressure in chambers 32, 62 or the passive and active slide valves 34, 61 are free to separate from each other due to suction pressure in chambers 32, 62. With regard to the term "pressure ratio", it is to be understood that in actual practice it is "pressure" that is measured and therefore the phrase "pressure ratio" is used in the program. The pressure ratio is used to obtain the volume ratio of the compressor according to the following formula:

$$\text{volume ratio} = [\text{pressure ratio}]^{\frac{1}{K}}$$

where K is a constant defined for each compressible fluid.

INITIATE TWIN SCREW SLIDE VALVE CONTROL

SET LIMITS
- MIN_SP = Minimum suction pressure
- MAX_SP = Maximum suction pressure
- MIN_TR = Minimum slide travel
- MAX_TR = Maximum slide travel
- MAX_VR = Maximum VR position -continued

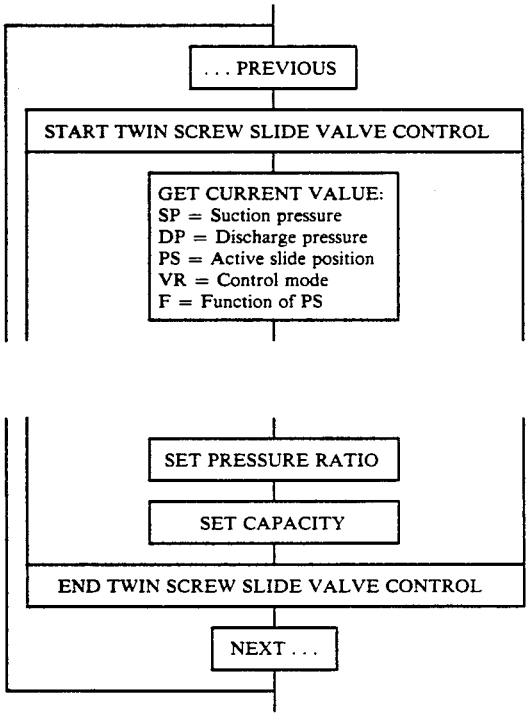

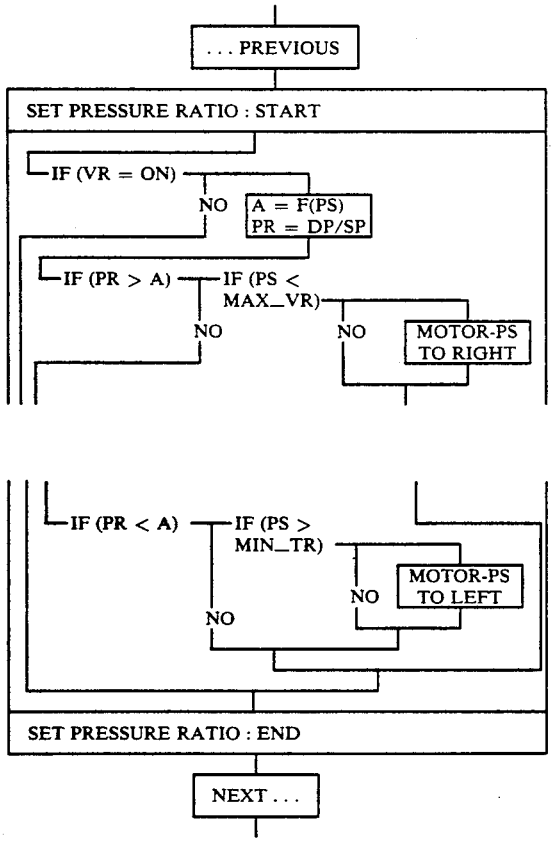

-continued

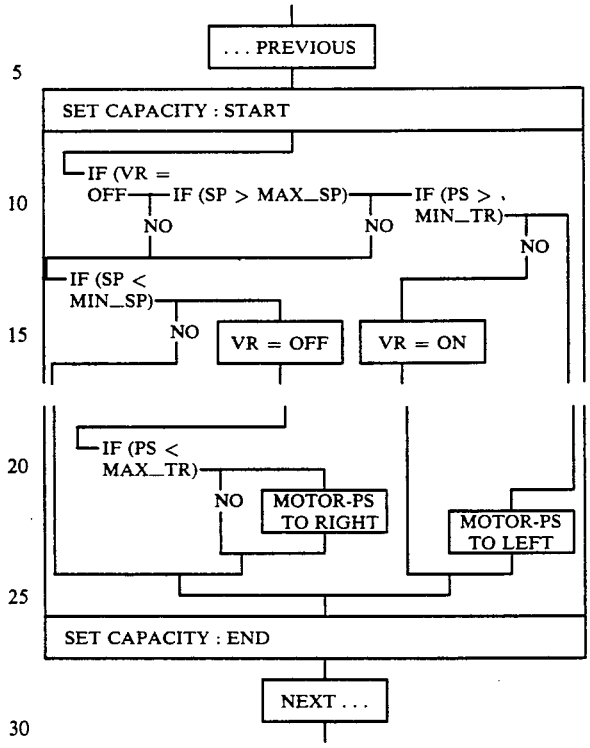

The control means 100 functions to control the volume ratio and the capacity of the compressor. With regard to the volume ratio, if the active slide valve 61 end face 72 is moved to the right toward the discharge edge 73, the gas will be trapped in the rotor groove chambers for a longer period of time and the volume of gas is reduced as its pressure is increased. This direction of movement of active slide valve 61 to the right results in an increase in volume ratio. As previously mentioned, this is sometimes referred to in the prior art as compression ratio. Conversely, if the active slide valve end face 72 is moved to the left away from discharge edge 73, the gas will remain trapped for a shorter period of time. Its volume will not be reduced as much and therefore its pressure at time of discharge will be lower. This direction of movement of active slide valve 61 results in a decrease in volume ratio.

In practice, if the compressor is to be operated at full load, the control means 100 will close valve 45 and open valve 85. Outer passive slide valve chamber 32 and outer active slide valve chamber 62 will both be at discharge pressure which will force the inner facing ends 36, 66 into abutting sealing engagement. In this operating mode, both sides 63A, 63B of piston 63 are exposed to discharge pressure and thus equalize each other. End face 72 is exposed to discharge pressure. However, with regard to piston 29, the side 29A facing outer chamber 32 is at discharge pressure but the side 29B facing inner chamber 38 is at suction pressure and, therefore, the axial force on face 72 is counterbalanced by an opposite equal force created by discharge pressure in outer chamber 32. As the position of the active slide valve 61 is regulated by motor 79, the passive slide valve 34 will automatically follow. As the end face 72 moves closer to or farther from discharge edge 73, the volume ratio is regulated, that is, it is increased or decreased but the capacity of the compressor is not changed.

Compressor capacity will now be discussed. As previously explained, if the end face 36 of passive slide valve 34 and the end face 66 of active slide valve 61 are held together in sealing relation, none of the gas can recirculate back to inlet 19 via opening 25A and the compressor will operate at maximum capacity. If the end faces 36, 66 are allowed to move apart to create a gap 69 therebetween, some of the gas trapped in the rotor compressor chambers can escape and recirculate via opening 25A back to the inlet 19 to reduce capacity. By increasing or decreasing the gap 69 between end faces 36, 66, the capacity can be increased or decreased.

For example, if the compressor is to operate at partial load, the control means 100 will open valve 45 and close valve 85. Passive slide valve outer chamber 32 and active slide valve outer chamber 62 will now both be at suction pressure. Therefore, the passive slide valve 34 and the active valve slide 61 will no longer be forced together and positive regulation of the active slide valve position by motor 79 is not followed by the passive slide valve. In this operating mode both sides of piston 29 are exposed to suction pressure which equalize each other. End face 72 is exposed to discharge pressure. However, with regard to piston 63, the side 63B facing outer chamber 62 is now at suction pressure but the side 63A facing discharge bore 49 is at discharge pressure and therefore the axial force on face 72 is counterbalanced by an opposite force generated by discharge pressure on side 63A of piston 63. Pressure of the gas in the rotor chambers will push the passive and active slide valves apart and if a compressor spring 71 is used, it will assist in such separation. The separation opens the variable gap 69 between inner facing ends 36, 66 which allows more or less gas to recirculate back to the inlet 19 to control the capacity.

By providing an arrangement wherein the passive slide chamber 32 and the active slide chamber 62 are both either at suction or discharge pressure, it is only necessary to provide for positive regulation of the position of the active slide valve 61. Therefore, the control means 100 need only sense three operating parameters: suction pressure, discharge pressure and the position of the active slide valve 61. This in turn simplifies the control system and allows for more rapid response time which minimizes compressor hunting to enable the compressor system condition to be more precisely controlled while also always providing a force on the active slide valve 63 that will counterbalance the axial thrust imposed by the discharge pressure in discharge bore 49.

I claim:

1. A variable capacity rotary screw compressor comprising:

a rotor housing including a bore means having an inlet at a suction pressure, an outlet at a discharge pressure and a slide valve recess in fluid communication between said bore and said inlet;

a rotor means mounted for rotation in said bore means to compress a fluid received from said inlet and discharge said fluid at a higher pressure into said outlet;

a passive slide valve means and an active slide valve means mounted for movement in said recess either to a sealing position to prevent fluid communication through said recess or to positions defining a variable volume opening placing said bore means and inlet in fluid communication;

a passive slide valve balancing means connected to said passive slide valve means and including a first pressure activated means having inner and outer pressure responsive portions, said inner portion permanently connected in open communication with said suction pressure;

an active slide valve balancing means connected to said active slide valve means including a second pressure actuated means having inner and outer pressure responsive portions, said inner portion permanently connected in open communication with said discharge pressure;

a prime mover connected to selectively regulate the position of said active slide valve means; and a control means operative to connect both of said outer portions of said first and second pressure activated means in fluid communication with either said suction pressure or said discharge pressure to counterbalance axial thrust on said active slide means with the use of either suction or discharge pressure and to activate said prime mover to regulate the position of said active slide valve means.

2. A variable capacity rotary screw compressor comprising:

a rotor housing including a bore means, an inlet at a suction pressure, a discharge bore having an outlet at a discharge pressure, an outer passive slide valve chamber, an inner passive slide valve chamber, an outer active slide valve chamber and a slide valve recess in fluid communication between said bore means and said inlet;

a rotor means mounted for rotation in said bore means to compress a fluid received from said inlet and discharge said fluid at a higher pressure through said outlet;

a passive slide valve means and an active slide means mounted in said recess for movement either to a sealing position to prevent fluid communication through said recess or to positions defining a variable volume opening placing said bore means and inlet in fluid communication;

a prime mover connected to selectively regulate the position of said active slide valve means;

a passive slide valve balancing means mounted between said outer and inner passive slide valve chambers and connected to said passive slide valve means;

an active slide valve balancing means mounted between said discharge bore and said outer active slide valve chamber and connected to said active slide valve;

duct means connecting said inner passive slide valve chamber in permanently open fluid communication with said suction pressure;

a conduit means including valve means for selectively connecting said outer passive and outer active slide valve chambers in fluid communication with either said suction or said discharge pressure; and a control means operatively connected to said valve means to place both said outer passive slide valve chamber and said outer active slide valve chamber in fluid communication with either said suction pressure or said discharge pressure to counterbalance axial thrust imposed on said active slide valve with the use of either the suction or discharge pressure and to actuate said prime mover to regulate the position of said active slide valve in said recess.

3. A variable capacity rotary screw compressor according to claim 2 wherein:

said conduit means includes, a first conduit means in fluid communication between said inlet and said outer passive and active slide valve chambers and a first valve means selectively operable to either close said first conduit means or open said first conduit means and place both said outer passive and active slide valve chambers in communication with said suction pressure, and a second conduit means in fluid communication between said outlet and said outer passive and active slide valve chambers and having a second valve means selectively operable to either close said second conduit means or open said second conduit means and place both said outer passive and active slide valve chambers in communication with said discharge pressure;

said compressor further includes, a first sensing means sensing said inlet suction pressure and providing a first signal proportional thereto;

a second sensing means sensing said outlet discharge pressure and providing a second signal proportional thereto;

a third sensing means for sensing the position of said active slide means and providing a third signal proportional thereto; and said control means is operatively connected to receive said first, second and third signals from said sensing means and provide first and second control outputs connected to said first and second valve means to open either said first or said second valve means and place both said outer passive and active slide valve chambers either in communication with said inlet or said outlet to counterbalance said active slide means with either suction or discharge pressure and to provide a third control output connected to said prime mover for regulating the position of said active slide valve means.

4. The variable capacity rotary screw compressor according to claim 3 wherein:

said first sensing means includes a suction pressure actuated transducer in fluid communication with said first conduit means;

said second sensing means includes a discharge pressure actuated transducer in fluid communication with said second conduit means; and said third sensing means includes a slide valve potentiometer connected to said prime mover.

5. The variable capacity rotary screw compressor according to claim 3 wherein:

said first and second valve means include first and second servomotors, respectively, and;

said first and second control outputs are connected to said first and second servomotors, respectively, to either open said first valve means and close said second valve means or to close said first valve means and open said second valve means.

6. The variable capacity rotary screw compressor according to claim 3 wherein:

said rotor casing includes a suction end portion having said inner and outer passive slide valve chambers therein;

said passive slide valve means includes a passive slide valve spool having an inlet end portion in permanently open fluid communication with said inner passive slide valve chamber; and said passive slide valve balancing means includes a first piston having first inner and outer sides, mounted between said inner and outer passive slide valve chambers and connected to said passive valve spool with said first inner side in fluid communication with said inner passive slide valve chamber and said first outer side in fluid communication with said outer passive slide valve chamber.

7. The variable capacity rotary screw compressor according to claim 3 wherein:

said rotor housing includes a discharge end portion that includes said discharge bore and outlet therein, interior and outer ends, and a compressed fluid admitting opening in said interior end in open communication with said bore means;

said active slide means includes an active slide valve spool having a discharge end portion in permanently open fluid communication with said discharge bore; and said active slide valve balancing means includes, a cylinder constituting said outer active slide valve chamber having an open end facing into said discharge bore, a second piston slidably mounted in said cylinder having second inner side in fluid communication with said discharge bore and a second outer side in fluid communication with said outer active slide valve chamber, and a piston connecting rod extending through said discharge bore and interconnected between said active slide valve spool and said second piston.

8. The variable capacity rotary screw compressor according to claim 7 wherein:

said piston connecting rod includes a gear rack thereon; and said prime mover includes a rotatable pinion gear in mesh with said gear rack and a motor means for rotating said pinion gear to reciprocate said connecting rod to regulate the position of said active slide valve means.

9. The variable capacity rotary screw compressor according to claim 8 wherein said active slide valve spool, piston connecting rod and piston comprise a one-piece unitary member.

10. The variable capacity rotary screw compressor according to claim 2 wherein:

said passive slide valve means includes a first inner facing end;

said active slide valve means includes a second inner facing end in confronting facing relation to said first inner facing end; and a spring means is mounted between said first and second inner facing ends.

* * * * *